US005594252A

United States Patent [19]

Day et al.

[11] Patent Number: 5,594,252

[45] Date of Patent: Jan. 14, 1997

[54] THREE TERMINAL ION CHAMBERS

[75] Inventors: Derek J. Day, Los Gatos, Calif.; Rolf Stähelin, Schlieren, Switzerland; Salvatore Provenzale, Gebenstorf, Switzerland; Heinrich Riem, Wettingen, Switzerland; Willi Fencl, Kloten, Switzerland

[73] Assignee: Varian Associates, Inc., Palo Alto, Calif.

[21] Appl. No.: 555,815

[22] Filed: Nov. 9, 1995

[51] Int. Cl.[6] ..... H01J 47/02

[52] U.S. Cl. ..... 250/385.1

[58] Field of Search ..... 250/385.1

[56] References Cited

U.S. PATENT DOCUMENTS

| | | | |
|---|---|---|---|
| 5,019,711 | 5/1991 | Antonuk | 250/385.1 |
| 5,025,376 | 6/1991 | Bova | 364/413.26 |
| 5,032,729 | 7/1991 | Charpak | 250/385.1 |
| 5,233,990 | 8/1993 | Barnea | 128/653.1 |
| 5,262,649 | 11/1995 | Antonuk | 250/370.09 |

FOREIGN PATENT DOCUMENTS

| | | | |
|---|---|---|---|
| 55-87069 | 7/1980 | Japan | 250/385.1 |
| 312219 | 8/1971 | U.S.S.R. | 250/385.1 |
| 2137747 | 10/1984 | United Kingdom | 250/385.1 |

OTHER PUBLICATIONS

M. van Herk, "Physical Aspects of a Liquid–Filled Ionization Chamber with Pulsed Polarizing Voltage"; Medical Physics, vol. 18, No. 4, Jul./Aug. 1991 pp. 692–702.

*Primary Examiner*—Constantine Hannaher
*Attorney, Agent, or Firm*—Bella Fishman; Kurt Maschoff

[57] ABSTRACT

A three terminal ionization chamber includes a first electrode coupled to a bias voltage source spaced apart from a second electrode coupled to ground. A third terminal is provided which is positioned between the first and second electrodes. Measurement circuitry may be coupled to the third terminal to measure charge indicative of the amount of radiation incident to the chamber.

15 Claims, 3 Drawing Sheets

THREE TERMINAL ION CHAMBERS

BACKGROUND OF THE INVENTION

The present invention relates to devices for the measurement and detection of radiation. More particularly, the present invention relates to liquid ionization chambers having three terminals.

Medical diagnostic procedures frequently rely on imaging systems and sensors to detect and measure radiation used for treatment. It is often necessary to expose a patient to a small amount of radiation after being positioned on a treatment table but before the primary treatment for the purpose of insuring that the patient is correctly positioned for radiation therapy. This is known as localization imaging. During treatment, it is necessary to insure that the patient has not moved and is in the correct position during treatment, and that the appropriate radiation profile is being applied. This is known as verification imaging, and typically consists of a series of individual images of the target area taken throughout the treatment session. Thus, systems used in verification imaging should be capable of the real-time generation of images.

Imaging systems used in these circumstances must be designed for high energy levels. The energy levels used in radiation therapy are generally greater than one million electron volts (MeV) and may typically range from 4 to 25 MeV. In these high radiation situations, it is essential that the treatment be properly directed at the correct treatment area of the patient's body. Further, it is also important that the amount of exposure to other parts of the patient's body be minimized. Thus, for an imaging system to be effective and useful during treatment and treatment planning, it must be suitable for use with high energy radiations, it must be accurate, and it must be able to provide real time images for an entire treatment session.

The most common approach to verification and localization imaging is to record a treatment or treatment sequence on film. Unfortunately however this approach requires delays of minutes or hours to develop the film which can lead to patient discomfort and movement during localization imaging, and cannot provide real time imaging capabilities for verification imaging. Further, the approach is not suitably accurate as patient movement may disturb results of localization imaging, and because the film does not reveal the exact quantity of radiation to which a target area has been exposed.

Another disadvantage of fill imaging systems is that they generally have inadequate resolution and dynamic range. In addition, it is typically not possible to use computer enhancement techniques to improve the image obtained on film. Further, these film systems require a high amount of operator intervention which could result in errors or movement of the patient during treatment. Thus, it would be desirable to provide a system which decreases the amount of operator intervention required and which increases the resolution of images obtained during imaging.

Another device which has been used to perform verification and localization imaging is the scanning two terminal liquid-filled ionization chamber. Examples of these systems are shown, e.g., in U.S. Pat. No. 5,019,711, issued May 28, 1991 to Antonuk, U.S. Pat. No. 5,025,376, issued Jun. 18, 1991 to Bova et al.

Two terminal liquid-filled ionization chambers are typically arranged in a two-dimensional matrix, rows of which are scanned to measure a current at each chamber. These ionization chambers may be regarded as parallel plate capacitors in which the region between plates is led with a liquid. The amplitude of the signal measured is proportional to the number of ions formed (and thus to the energy deposited by the radiation). The radiation intensity is recorded as a current. The ionization current measured is proportional to the energy of the radiation. Thus, higher energy radiation gives more ionization and a greater response.

The current being monitored in such two terminal liquid ion chambers consists of two components: one due to the current flowing to charge the electrode structure and to provide an electric field between the electrodes; and the other component attributable to ion motion in that field. Because only two terminals are used in these devices, the two currents must occur in parallel paths sharing the same terminals. The ion current is the signal current representing the presence of radiation, while the charging current is a transient of the measuring circuit, and must be separated from the signal current. The separation of these two currents may be achieved in the time domain by making the charging current transient much faster than the signal sampling. However, since the stone amount of charge is required to charge the electrodes to any bias voltage, reducing the charging time causes an increase in the charging current. This increasing current can cause problems through radiated power, output resistance of power supplies or switches, and the saturation of signal amplifiers. These effects can compromise the degree of separation that could be achieved between these currents. The net result is that the degree of accuracy and the ability to operate in a real time environment under high MeV conditions is limited. Thus, it is desirable to provide a liquid-filled ionization chamber which can operate accurately in such conditions. Further, it would be desirable to provide such a chamber without requiring more complex monitoring and amplification electronics.

Accordingly, an ionization chamber which allows an increase in the resolution of images obtained during real time imaging procedures is needed. Preferably, the chamber should be capable of operating with high, photon limited, signal to noise ratios, and other performance characteristics making it suited to dosimetry applications.

SUMMARY OF THE INVENTION

A three terminal ionization chamber is provided which includes a first electrode coupled to a bias voltage source spaced apart from a second electrode coupled to ground. A third terminal is provided which is positioned between the first and second electrodes. Measurement circuitry may be coupled to the third terminal to measure charge indicative of the mount of radiation incident to the chamber.

The three terminal chamber may be provided in a number of configurations, including flat, flat with button contacts, flat with bifurcated contacts, and cylindrical. These three terminal chambers provide radiation measurement capabilities by measuring voltage generated by space charge effects within the ionization chamber. Unlike two terminal devices, these three terminal chambers do not require the separation of bias and readout currents to generate an accurate measurement.

Other embodiments of the present invention employ blocking contacts in the chamber. One or two blocking contacts may be formed by placing a layer of dielectric material along one or more of the electrodes. The third terminal is formed along a surface of a layer of dielectric material. Measurements of signal charge are taken from the third terminal.

A method for measuring the ionization current in an ionization chamber is also provided. The method employs a three terminal chamber to take a voltage measurement at a third electrode. The ionization current is calculated using this measured voltage.

These embodiments of ionization chambers offer distinct enhancements to the prior art of ion detection. Unlike prior devices, these chambers ensure that ion recombination is reduced during operation, thereby enhancing the magnitude and linearity of the responsivity to applied doses. These devices, therefore, are capable of operating with high, photon limited, signal to noise ratios making them suited for dosimetry applications. Further, the devices are capable of integration of signal charges in biased and unbiased states, making them open to many more device architectures and modes of operation than previous designs.

For a fuller understanding of the nature and advantages of the invention, reference should be made to the ensuing description taken in conjunction with the accompanying drawings.

DESCRIPTION OF THE PREFERRED EMBODIMENTS

Figure 1:
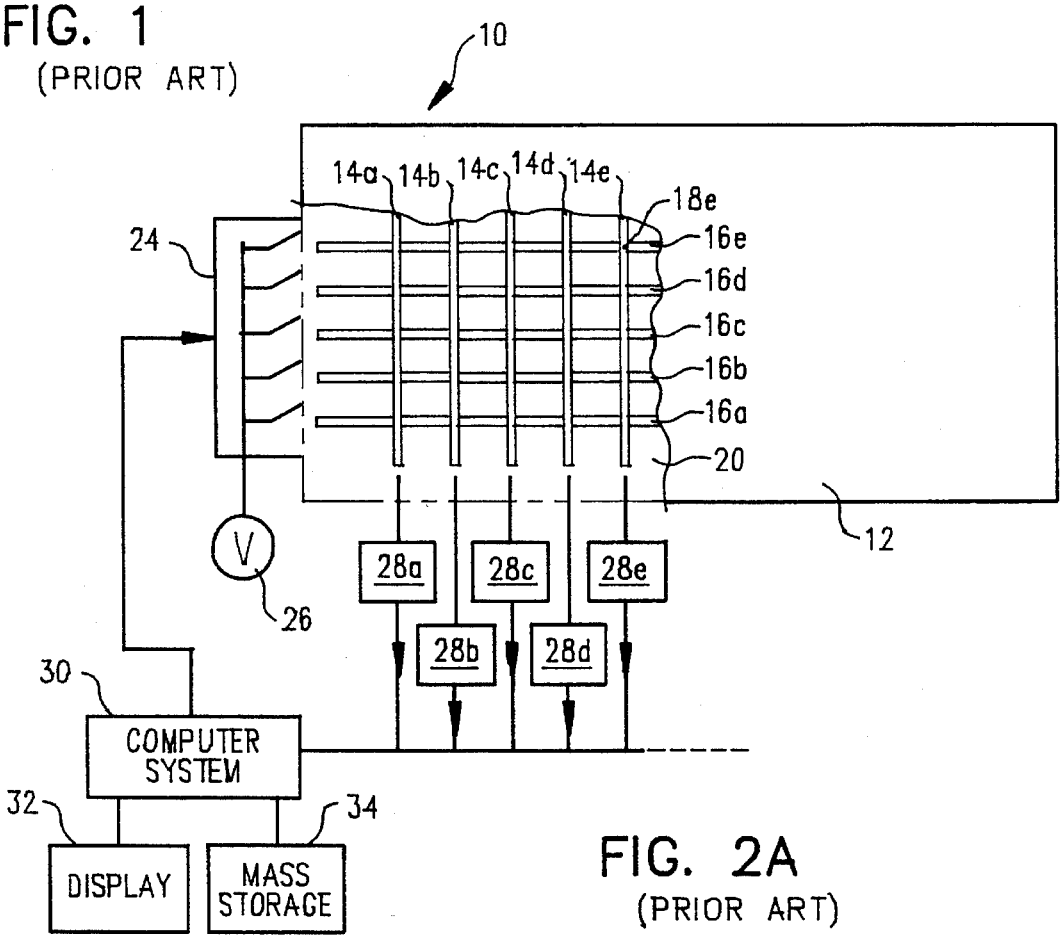
FIG. 1 (PRIOR ART)
FIG. 1 is a schematic block diagram depicting components of a conventional imaging system.

Prior to discussing embodiments of the present invention, one specific application for liquid filled ionization chambers will be described. The specific application will first be described in its use with existing two terminal ionization chambers; later, the application will be described for use with three terminal chambers according to the present invention. FIG. 1 depicts an illustrative imaging system typically referred to as portal imaging system 10. Portal imaging systems are currently used with two terminal ionization chambers. System 10 may include, for example, portal assembly 12 which houses a matrix of electrodes 14, 16. Electrodes 14, 16 are typically formed on sheets of printed circuit board positioned parallel to each other so that each of electrodes 14, 16 is separated some distance, e.g., 1 min. Electrodes 14, 16 may be, e.g., approximately 0.5–0.8 nun in width. Interior 20 of portal assembly 12 is filled with a liquid, such as 2,2,4 trimethylpentane, chosen for electron mobility characteristics. The point at which each electrode 14, 16 crosses forms an individual ionization chamber 18.

In one typical imaging system, portal assembly 12 holds a matrix of 256 by 256 electrodes (forming a total of 65,536 individual ionization chambers). Each of the chambers is approximately 1.27×1.27×1 mm in size. The bias electrodes 16 may be coupled to a high voltage source 26 (e.g., 250–300 Volts) via a switching bank 24. For existing two terminal systems, each electrode 14 is coupled to a series of detection circuits 28 to provide measurements of electrical characteristics of each chamber 18 proportional to the incident radiation thereon. Radiation is applied to the patient in a series of short pulses, e.g., 6 μs. The frequency of the pulses may be varied to increase or decrease the dosage as needed for a particular treatment. Cycles of between 60 to 300 pulses per second are common.

Existing portal imaging systems operate in the following manner. A polarizing voltage pulse is applied to a bias electrode (e.g., electrode 16*e*) by activating an appropriate switch-in switch bank 24 (controlled by computer system 30). The voltage pulse is generally longer in length than the cycle time of the incident radiation. For example, the voltage pulse may be 20 ms in length. This will generate ionization currents in each of the ionization chambers 18 which may be measured. For a two terminal ionization chamber, the measurement is taken by sensing the current on each of the electrodes 14. These measurements may be stored in the computer system 30 as a first set of image data (e.g., 1×256 bits in size). The initial set of image data is augmented by subsequently applying a polarizing voltage pulse to a second bias electrode (e.g., electrode 16*d*) by activating the appropriate switch of bank 24 using computer 30. This process repeats sequentially through each electrode until a full image (e.g., 256×256 in size) is completed. With a pulse length of 20 ms, a complete image may be generated in approximately 5*s*. This image may be displayed on display screen 32 for treatment monitoring, or it may be stored in mass storage device 34 for later use, manipulation, or enhancement.

Figure 2A:
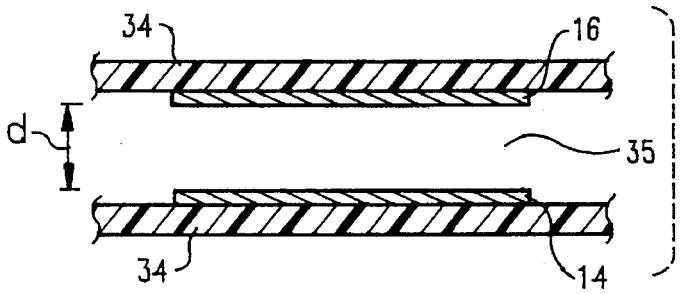
FIG. 2A (PRIOR ART)
FIG. 2A is a side cross-sectional view of a conventional two terminal ionization chamber for use in the imaging system of FIG. 1.

As mentioned, when two terminal ionization chambers are used, the ionization current may be measured using one of the two electrodes. Two electrodes 14, 16 are shown in FIG. 2A. Electrodes 14, 16 may be formed on facing surfaces of two printed circuit boards 34. A volume of liquid 35 is disposed between the two electrodes. When a polarizing voltage is placed across the two electrodes the electric field keeps the ions from recombining with electrons. An ionization current is generated which is proportional to the radiation intensity at the time of measurement. In the chamber depicted, a polarizing pulse is applied to the upper electrode 16 and resulting ionization current is measured on lower electrode 14. This readout process, unfortunately, is destructive to any integrated ion density so that signal integration only occurs while the device is unbiased.

Figure 2B:
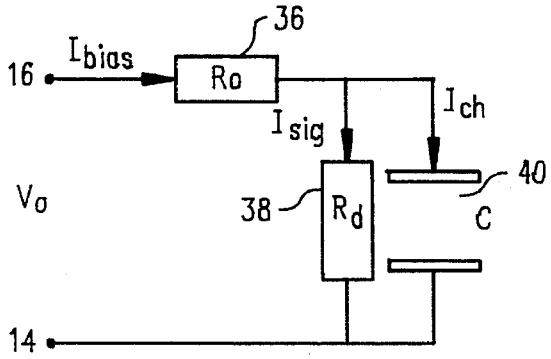
FIG. 2B (PRIOR ART)
FIG. 2B is a circuit diagram depicting electrical characteristics of the conventional two terminal ionization chamber of FIG. 2A.

Due to the configuration of the device, the current being monitored has two components. This is shown in FIG. 2B, where a circuit representation of the two terminal chamber is shown. The two terminal chamber can be represented as having input resistance 36, capacitance 40, and dielectric resistance 38. The measured ionization current ($I_{sig}$) is based on a component $I_{bias}$ attributed to the current used to bias the chamber minus a component $I_{ch}$ which is a transient of the measuring circuit. The transient $I_{ch}$ must be separated from the signal current $I_{sig}$to properly measure the ionization current in the chamber. This separation can be done in the time domain by making the transient much faster than the signal sampling. However, because the same amount of charge is required to charge the electrodes to any bias voltage, reducing the charging time increases the charging current. This, unfortunately, can cause problems through radiated power, output resistance of power supplies or switches, and the saturation of signal amplifiers, all of which can compromise the degree of separation that could be achieved between these currents. Two terminal chambers, thus, provide a limited ability to measure incident radiations at fast scanning rates.

Figure 3A:
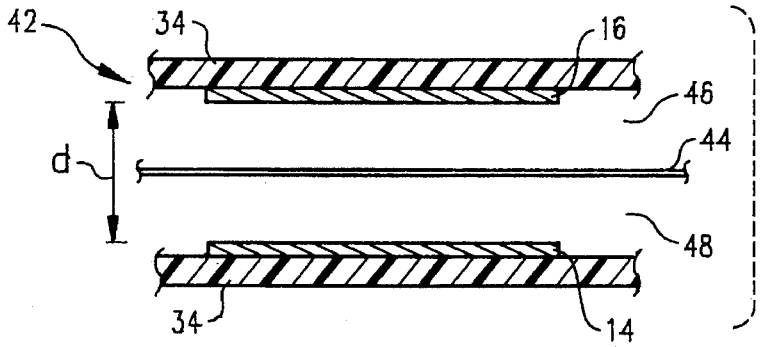
FIG. 3A is a side cross-sectional view of a three terminal ionization chamber according to the present invention.

Accordingly, a three terminal chamber has been developed. One embodiment of three terminal chamber 42 according to the present invention is shown in a side cross-sectional view in FIG. 3A. As in a two terminal chamber, the device may be constructed using two parallel printed circuit boards 34 with conductive electrodes 14, 16 placed on facing surfaces. In three terminal chamber 42, however, third electrode 44 is provided. Third electrode 44 divides the liquid in the chamber into generation volume 46 and sample volume 48. Third electrode 44 may be, e.g., a thin copper wire or other conductive element. As in two terminal chambers, measurements of the magnitude of radiation present are taken by applying a polarizing voltage to electrode 16. In three terminal chamber 42, however, measurement of the ionization current is taken by sensing the voltage difference across the sample volume (i.e., between electrodes 44 and 14). This voltage difference is attributable to space charge effects having a direct correlation to the magnitude of radiation. Those skilled in the art will recognize that circuitry such as a differential amplifier may be employed to sense the voltage difference. If three terminal chamber 42 is implemented in a portal imaging system such as the one depicted in FIG. 1, detection circuitry 28 should include differential amplifiers and the like to extract the charge from the third terminal of each chamber.

Figure 3B:
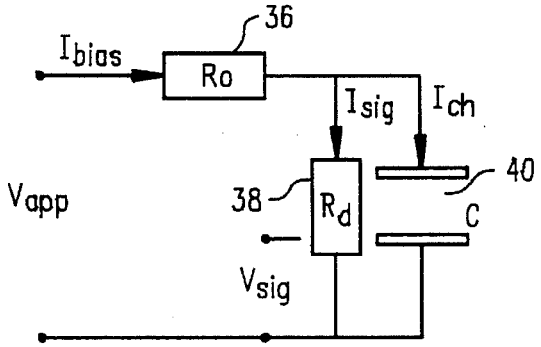
FIG. 3B is a circuit diagram depicting electrical characteristics of the three terminal ionization chamber of FIG. 3A.

As shown in FIG. 3B, the measured voltage ($V_{sig}$) is a direct indication of the magnitude of the ionization current flowing through the liquid. The location of third electrode 44 in the liquid (i.e., the size of sample volume 48) is selected to be a known fraction (f) of the total liquid volume (e.g,. 10–40%). As a result, the measured voltage $V_{sig}$ and the effective resistance of the liquid $R_d$ indicate the ionization current in the chamber ($V_{sig}=f*I_{sig}*R_d$). This approach to measuring ionization current is made possible by exploiting the space charge effects in the ionization chamber. These effects will now be described to enable those skilled in the art to design three terminal liquid-filled ionization chambers of different dimensions and characteristics.

Radiation incident on ion chamber 42 generates pairs of positive and negative ions as it passes through the chamber. Without any external bias these ions attract and screen each other so that there is no net charge in the chamber. Due to their close proximity the ion pairs will recombine again after some mean lifetime. When bias is applied to this neutral plasma it causes the ions of different charge to move in opposite directions, so that the ion pairs separate or polarize. As the ions separate they cause a space charge field between them (because lines of field begin and end on points of opposite electric charge). Poisson's Equation describes this divergence in field due to a steady state ion charge density $q*N_{ss}$. Manipulation of Poisson's Equation shows that the space charge voltage between ion pairs of density $N_{ss}$, for a uniform charge density, is as follows (Formula 1):

$$V_{sc}=q*N_{ss}*d^2/2\epsilon*\epsilon_0 \qquad \text{(Formula 1)}$$

Thus, the space charge voltage depends on the density, the charge q, the distance of separation d, the dielectric constant $\epsilon$ of the media, and the dielectric constant $\epsilon_0$ of vacuum. Typical values of the variables are: $N_{ss}=2\times10^{10}$ $cm^{-3}$, d=1.0 mm, and $\epsilon=2$; while the constants have values of: $q=1.6\times10^{-9}$ C, and $\epsilon_0=8.85\times10^{-14}$ F/cm), for which the space charge voltage may be solved as: $V_{sc}=0.9$ volt per contact. This space charge voltage opposes the applied voltage and so decreases the field for the-remaining neutral plasma while increasing the voltage drop at the contact electrodes 14, 16.

Space charge effects therefore grow at the electrodes during separation of the migrating ion pairs, but then must decrease as the ions are swept out at the contacts. This time dependence of the space charge voltage may be calculated using Formula 2:

$$V_{sc}V_o^2*\mu*\tau*[1+\exp-(2t/\tau)-2\exp-(t/\tau)]/2d^2 \qquad \text{(Formula 2)}$$

Formula 2 shows that the space charge grows exponentially with a characteristic time $\tau$, and increases as the square of the applied voltage $V_o$, where here $\mu$ is the mobility of the ion species migrating away from the contact, whose motion is uncovering space charge migrating to the contact under consideration.

Figure 4A:
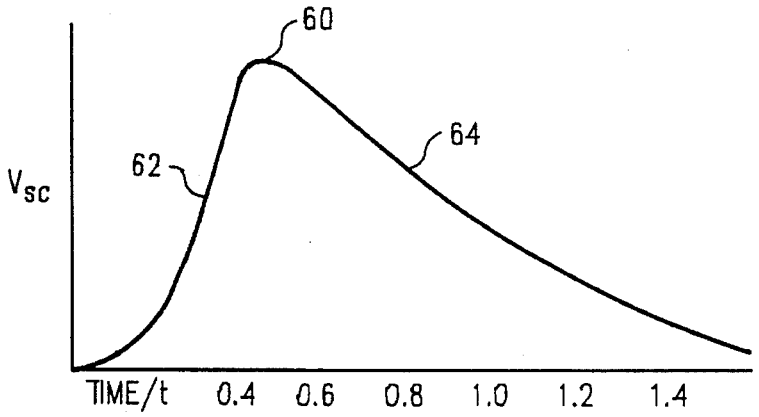
FIGS. 4A–B are charts depicting space charge effects.

FIG. 4A shows characteristics of the space charge voltage ($V_{sc}$) over time, measured from the application of voltage $V_o$. Fast ions are first swept out, increasing $V_{sc}$ along ramp 62 until a cross over point 60. The maximum space charge occurs at the cross over point 60; the point at which space charge edges from the two electrodes cross each other. From then on the remaining space charge is being swept out of the contact (along ramp 64) so that the contact voltage decreases. The time history of this decay will be the inverse of its growth but with the characteristic time now being determined by the mobility of the ions migrating to the contact. Thus, the space charge generated within an ionization chamber tends to collapse at some point in time, allowing a chamber to reset to an equilibrium condition. This enables greater accuracy in measurements.

Formula 3 may be used to estimate the distances (X) swept out at a time (t), while Formula 4 defines the maximum penetration distance ($X_{max}$) of the space charge.

$$X=V_o*\mu*\tau*[1-\exp-(t/\tau]/d \qquad \text{(Formula 3)}$$

$$X_{max}=V_o*\mu*\tau/d \qquad \text{(Formula 4)}$$

This is the mean maximum distance traveled by an ion in the dielectric relaxation time $\tau$. For example, for a $V_o$ of 300 Volts, and a distance between electrodes (d) of 1.0 mm, $X_{max}$ is equal to approximately 1.6 mm.

Figure 4B:
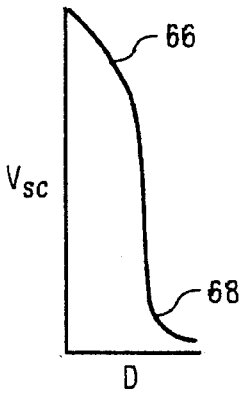

The relationship between the space charge voltage $V_{sc}$ and the penetration distance from the electrode ($X_{max}$) is shown in FIG. 4B. If the device length is greater than this maximum penetration distance ($X_{max}$) then the space charge will limit any further ion migration and the ion current will approach zero. If, however, the device length is less than this maximum penetration distance, the ions will get swept out at the electrodes and the space charge will collapse. Because space charge attraction is the initial restoring force causing the ion pairs to come close enough for rapid recombination to occur, the dielectric relaxation time $\tau$ is also effectively the ion pair recombination life time. The maximum penetration distance ($X_{max}$) is therefore simply the drift length of ions in the applied field. The net result of the space charge effect is to change the potential distribution within a parallel plate ionization chamber such that there are high fields at the electrodes 14, 16 and low fields within the device.

These characteristics of space charges which exist in parallel plate ionization chambers may be exploited by introducing a third terminal 44 in the chamber. The third terminal may be a voltage contact positioned between two current carrying electrodes 14, 16. This third terminal monitors the voltage change due to the nonuniform field associated with space charge at one of the current contacts as described by Formula 2, above.

These three terminal ionization chambers exhibit improved performance over previous devices. For example, these devices permit resetting of the charge in individual chambers to zero-a feature unavailable in previous two terminal devices. An essential feature of an integrating system is the ability to reset the charge to zero to initialize an integration period. Without this ability, the system is subject to erroneous measurements as transients disrupt the integration period. In embodiments of the present invention, the reset function can be achieved by charge extraction at the third terminal to provide destructive sensing. Loss of ion pairs by recombination or leakage could also be used to achieve a steady state level that could be adjusted by cycling the bias on field electrodes 14, 16 to cause the ions to move together and recombine more quickly than when polarized.

Figure 5A:
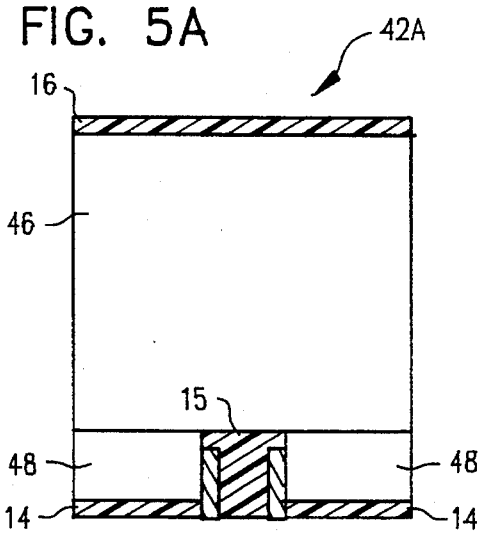
FIGS. 5A–D are sectional views showing alternative three terminal ionization chamber design according to embodiments of the present invention.

One embodiment of a three terminal ionization chamber has been described in conjunction with FIG. 3. Other configurations, however, are also possible, such as the embodiments shown in FIG. 5A–B. FIG. 5A shows a three terminal chamber 42A which uses button contact 15 as the third terminal. Button contact 15 protrudes through a via in a printed circuit board layer. Measurements of space charge effects may be taken by coupling measurement circuitry to the button contact 15.

Figure 5B:
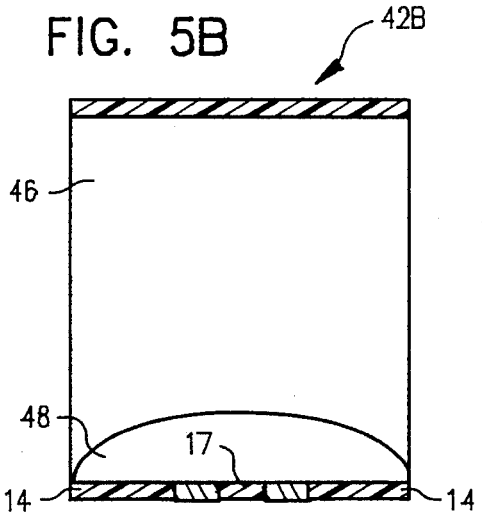

FIG. 5B depicts an alternative embodiment of a three terminal chamber 42B which uses a bifurcated contact scheme. The bias electrode 14 is split into two separate lines along the base of the chamber. The signal electrode 17 is positioned between bias electrodes 14. In this embodiment, sample volume 48 is spread in a horizontal direction within the chamber. The spacing between bias electrodes 14 must be less than $X_{max}$ to capitalize on the space charge effects described above.

Figure 5C:
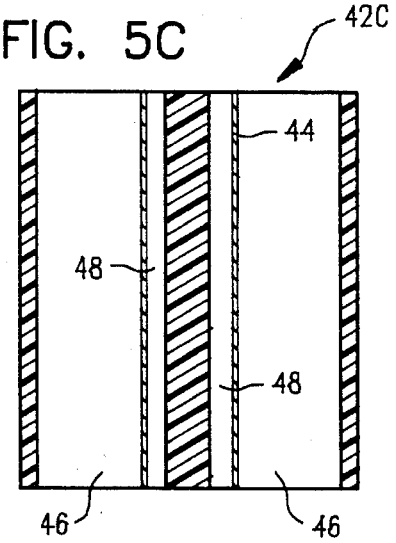
Figure 5D:
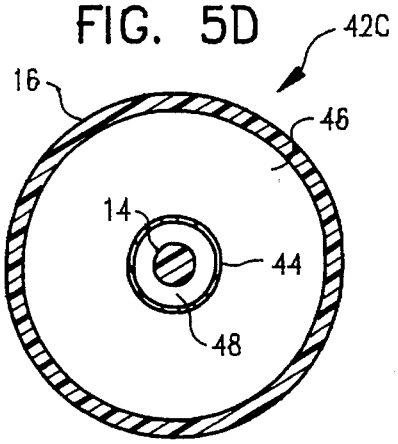

FIGS. 5C–D depict a cylindrical three terminal chamber 42C. This configuration yields a non-uniform field with space charge effects greatest at the center of the cylinder. This embodiment yields the largest signal for any given bias voltage.

Those skilled in the art will recognize that other configurations may also be employed; however, the voltage probe or contact generally should not be placed close to the midpoint between the two electrodes 14, 16. As described above, the space charge voltage diminishes near the midpoint between the two electrodes. Instead, the voltage probe or contact should be placed within one drift length of either of the current carrying electrodes. Further, the two current carrying electrodes should be placed more than two drift lengths apart so that the midpoint can be avoided.

Each of the three terminal chambers described in conjunction with FIGS. 3–5 may be implemented in the portal imaging system 10 of FIG. 1 by the addition of third terminals within each chamber and by the inclusion of appropriate detection circuitry 28 coupled to each column of chambers. The resulting portal imaging system 10 exhibits improved performance characteristics over previous two terminal devices.

Figure 6A:
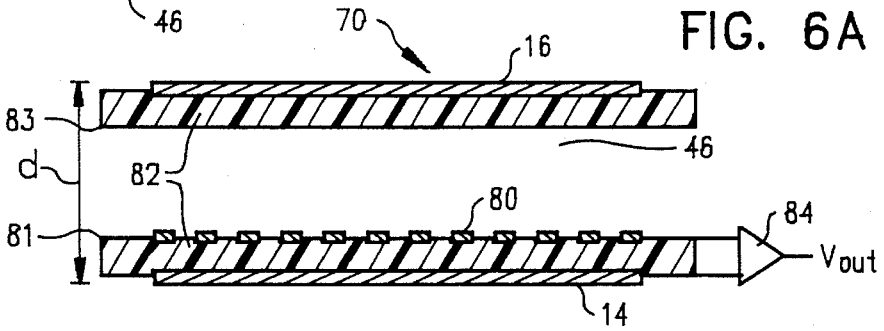
FIGS. 6A–B are sectional views depicting further embodiments of three terminal ionization chambers according to the present invention.

A second general embodiment of three terminal ionization chambers will now be described by referring to FIG. 6A. In this embodiment, ionization chamber 70 employs a third contact formed as a grid of contacts 80. As in the chambers discussed above, this chamber 70 includes two parallel electrodes 14, 16 spaced a distance (d) apart. In this embodiment, however, a layer of dielectric material 82 is placed along the interior surface of electrodes 14 and 16 and a grid of contacts 80 is positioned on the surface of one of the layers of dielectric material. Grid of contacts 80 are used as a voltage probe contact in the chamber (i.e., the third terminal of the device). A layer of liquid 46 is also disposed between the two electrodes 14, 16. Grid of contacts 80 may be formed from thin copper sheeting, wire mesh, or other conductive material which may be formed across a surface of dielectric layer 82. Dielectric layers 82 may consist of thin sheets of solder masks or other similar dielectric material having insulating characteristics. In one specific embodiment, dielectric layers 82 are 0.1 mm wide and electrodes 14, 16 are spaced a distance of 1 mm apart.

This embodiment also takes advantage of space charge effects within chamber 70. In this embodiment, no ion current is withdrawn; instead, only the displacement current needed to develop the space charge field is measured. Dielectric layers 82 in combination with electrodes 14, 16 serve to form blocking contacts or blocking interfaces to which ions are attracted. Ions are stored or blocked at interfaces 81, 83 between the dielectric sheets 82 and the liquid 46, allowing the ions to accumulate. It is known in the art that such an interface occurs between two dissimilar materials (e.g., liquid and solid) where the conduction induced by radiation is different in magnitude or mechanism. For example, systems of two electrodes with liquid and dry film layers sandwiched between them have given a 40:1 decrease in ion current compared with a system having just liquid as a dielectric, for the same radiation conditions. This embodiment of the present invention capitalizes on this feature by attracting charge induced in the conductive media to interfaces 81, 83 by polarizing electrodes 14, 16. The charge induced is monitored by third terminal 80 (e.g., a wire mesh or grid) at interface 81. Insulator 82 thus forms a capacitor between field electrode 14 and third terminal 80 that integrates charge in the conductive media while bias is applied. Again, third terminal 80 may be formed from thin conductive lines or grid to allow charge accumulation at interface 81 while averaging the space charge over an area. The charge induced may, e.g., be monitored using differential amplifier 84 producing a measured voltage output $V_{out}$.

This embodiment of three terminal chamber 70 integrates ion current from conductive media 82 on the capacitor formed by third terminal 80 and field electrode 14. This charge accumulates until either the space charge voltage formed by the interface charge offsets the voltage across the field electrodes 14, 16, or until recombination of these ions equals the gain from the ion current.

Charge integration occurs for this device in either the conductive media 82 when bias is not applied or at the insulator interface 81 while bias is applied. This makes the device open to many modes of operation dependent on whether radiation is coincident with bias or not. Sensing of this charge at third contact 80 can also be achieved as either a voltage or extracted as charge. This makes the device 70 open to many different system architectures.

Figure 6B:
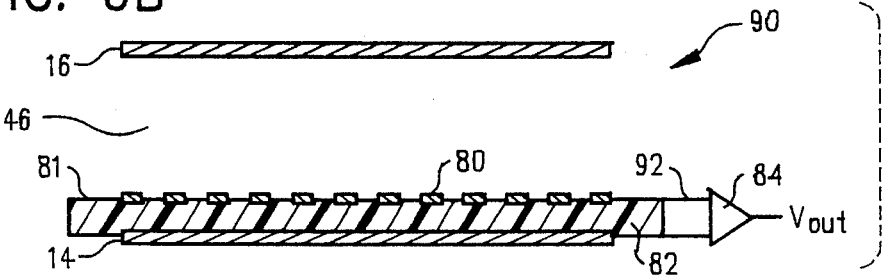

A further embodiment of a three terminal ionization chamber of the present invention, shown in FIG. 6B, constitutes a chamber 90 formed from a combination of conductive and blocking contacts. This embodiment includes two parallel field electrodes 14, 16 spaced a distance (d) apart. A single layer of dielectric material 82 is placed along one electrode 14. Liquid 46 fills the remainder of chamber 90. A grid of contacts 80 is positioned along interface 81 between liquid 46 and dielectric 82. Thus, the device includes a single blocking contact formed from dielectric material 82 and electrode 14. Electrode 16 is not formed as a blocking contact. This combination allows ions of one charge type (electrons might be preferred when metal contacts are used) to be swept out of the chamber 90 at the conductive contact 16 while the space charge induced by the other ion charge is accumulated at the blocking contact. This ion charge may be monitored at the third terminal (the grid of contacts 80) using, e.g., a differential amplifier to produce a voltage signal indicative of the charge. Twice the charge can now be accumulated at the interface for the same applied voltage. Sweep out of the unstored ions at conductive contact 16 implies that ion recombination would not be important in limiting the accumulation of ions at the interface. Again, this embodiment may be implemented in portal imaging system 10 such as the one depicted in FIG. 1. Those skilled in the art will recognize that appropriate detection circuitry 28 will be required.

A further modification to the three terminal chamber depicted in FIG. 6B may be made by omitting third terminal 92 since charge and voltage at interface 81 can be monitored from the conducting electrode 16 once the external bias has been removed. This is because ions will remain stored in the system until they can migrate from interface 81 to conducting electrode 16. This migration can be enhanced by reversing the applied bias to sweep out the stored ions. This constitutes a further embodiment of the present invention, where the third terminal is implicit rather than explicit in the operation of the device.

The transfer of stored ions from a blocking contact to a conductive contact is extended in yet a further embodiment through a multiplicity of two or three terminal contacts that allow transfer of that charge between adjacent blocking contacts. Charge within the ion chamber can then be manipulated and transported in a manner analogous to that employed in a solid state charge coupled device (CCD).

Those skilled in the art will recognize that each of the embodiments of the present invention which have been described (e.g., in conjunction with FIGS. 3–5) may be implemented in portal imaging systems 10 as shown in FIG. 1. Rather than measuring incident radiation by sensing current on electrodes 14, systems using embodiments of the present invention include a third electrode (e.g., electrode 44 of FIG. 3) coupled to detection circuits 28.

As will be appreciated by those familiar with the art, the present invention may be embodied in other specific forms without departing from the spirit or essential characteristics thereof. For example, the relative sizings of the electrodes and the individual ionization chambers may be modified. Other conductive materials and dielectric liquids may also be employed. Skilled practitioners will also recognize that embodiments of the present invention may be adapted for uses other than portal imaging. For example, chambers constructed in accordance with principles of the invention may be used in dosimetry applications.

Accordingly, the disclosure of the invention is intended to be illustrative, but not limiting, of the scope of the invention which is set forth in the following claims.

What is claimed is:

1. A three terminal ionization chamber, comprising:

a first electrode coupled to a bias voltage source;

a second electrode, spaced a distance apart from said first electrode, coupled to ground;

a third electrode, positioned between said first and second electrodes;

a dielectric sheet positioned between said second and third electrodes; and measurement circuitry, coupled to said second and third electrodes for measuring radiation incident to said chamber.

2. The three terminal ionization chamber of claim 1 further comprising a volume of liquid between said first and second electrodes.

3. The three terminal ionization chamber of claim 2 wherein said third electrode divides said volume of liquid into a sample volume and a generation volume, said sample volume having an effective resistance, and wherein said measurement circuitry includes:

an amplifier coupled to said second and third electrodes producing a first signal indicative of a voltage across said second and third electrodes; and processing circuitry coupled to receive said first signal, said processing circuitry generating a second signal indicative of an ionization current within said chamber, said second signal depending upon said first signal and upon said space charge voltage of said sample volume.

4. The three terminal ionization chamber of claim 1 further comprising:

an additional dielectric sheet positioned along a surface of said first electrode facing said third electrode.

5. The three terminal ionization chamber of claim 4, wherein said third electrode is formed from a wire mesh.

6. The three terminal ionization chamber of claim 4, wherein said first and second electrodes are formed from conductive sheeting.

7. A portal imaging system comprising:

a matrix of three terminal ionization chambers, said matrix having a plurality of rows and a plurality of columns;

a plurality of measurement circuits coupled to said plurality of columns of said matrix, said measurement circuits coupled between a first and a second terminal of said three terminal ionization chambers and generating signals indicative of the magnitude of radiation incident on each of said chambers;

a plurality of bias voltage sources coupled to said plurality of rows of said matrix, said bias voltage sources coupled to a third terminal of said three terminal ionization chambers; and a storage device coupled to said plurality of measurement circuits for storing said signal produced by said measurement circuits.

8. The portal imaging system of claim 7 wherein said second terminal is a conductive wire positioned between said first and third terminals of each of said ionization chambers.

9. The portal imaging system of claim 7 wherein said second terminal is a button terminal positioned between said first and third terminals of each of said ionization chambers.

10. The portal imaging system of claim 7 wherein said second terminal is a bifurcated contact formed adjacent said first terminal.

11. The portal imaging system of claim 7 further comprising a first dielectric sheet positioned between said first and second terminals of each of said ionization chambers, said second terminal formed from a wire mesh positioned along a surface of said first dielectric sheet facing said third terminal.

12. The portal imaging system of claim 11 further comprising a second dielectric sheet formed along a surface of said third terminal facing said second terminal of each of said ionization chambers.

13. A method for measuring ionization current in a liquid filled ionization chamber, the method comprising the steps of:

placing a first electrode at ground potential;

biasing a second electrode, spaced a distance apart from said first electrode, at a bias voltage;

positioning a third electrode apart from said first and second electrodes;

positioning a first dielectric sheet between said first and third electrodes;

measuring a second voltage at said third electrode; and calculating an ionization current based upon said measured second voltage.

14. The method of claim 13, further comprising the step of positioning a first dielectric sheet between said first and third electrodes.

15. The method of claim 14, further comprising the step of positioning a second dielectric sheet along a surface of said second electrode facing said third electrode.

* * * * *